US006332436B1

(12) United States Patent
Di Lieto et al.

(10) Patent No.: US 6,332,436 B1
(45) Date of Patent: Dec. 25, 2001

(54) METHOD FOR THE CONTROL OF ELECTROMAGNETIC ACTUATORS FOR THE ACTUATION OF INTAKE AND EXHAUST VALVES IN INTERNAL COMBUSTION ENGINES

(75) Inventors: Nicola Di Lieto, Salerno; Gilberto Burgio, Ferrara; Roberto Flora, Florli', all of (IT)

(73) Assignee: Magneti Marelli S.p.A., Milan (IT)

( * ) Notice: Subject to any disclaimer, the term of this patent is extended or adjusted under 35 U.S.C. 154(b) by 0 days.

(21) Appl. No.: 09/722,714

(22) Filed: Nov. 28, 2000

(30) Foreign Application Priority Data

Nov. 30, 1999 (IT) ..... BO99A 0656

(51) Int. Cl.[7] ..... F01L 9/04

(52) U.S. Cl. ..... 123/90.11; 251/129.01; 251/129.16

(58) Field of Search ..... 123/90.11; 251/129.01, 251/129.1, 129.15, 129.16

(56) References Cited

U.S. PATENT DOCUMENTS 5,988,123 * 11/1999 Miyoshi et al. ..... 123/90.11
6,152,094 * 11/2000 Kirschbaum ..... 123/90.11
6,234,122 * 5/2001 Kirschbaum et al. ..... 123/90.11

* cited by examiner

*Primary Examiner*—Weilun Lo
(74) *Attorney, Agent, or Firm*—Arent Fox Kintner Plotkin & Kahn, PLLC

(57) ABSTRACT

A method for the control of an electromagnetic actuator coupled to a respective valve and provided with a moving member actuated magnetically, by means of a net force, in order to control the movement of the valve between a closed position and a position of maximum opening, a pair of electromagnets disposed on opposite sides with respect to the moving member and an elastic member adapted to maintain the valve in a rest position. The method comprises the stages of estimating the disturbing forces acting on the valve, calculating an actual force as a function of the objective force value and the disturbing forces and implementing this actual force value.

13 Claims, 6 Drawing Sheets

METHOD FOR THE CONTROL OF ELECTROMAGNETIC ACTUATORS FOR THE ACTUATION OF INTAKE AND EXHAUST VALVES IN INTERNAL COMBUSTION ENGINES

The present invention relates to a method for the control of electromagnetic actuators for the actuation of intake and exhaust valves in internal combustion engines.

BACKGROUND OF THE INVENTION

As is known, drive units are currently being tested in which the actuation of the intake and exhaust valves is managed by using actuators of electromagnetic type that replace purely mechanical distribution systems (camshafts). While conventional distribution systems make it necessary to define a valve lift profile that represents an acceptable compromise between all the possible operating conditions of the engine, the use of an electromagnetically controlled distribution system makes it possible to vary the phasing as a function of the engine point in order to obtain an optimum performance in any operating condition.

The increase in efficiency and the actual savings resulting from the use of actuators of electromagnetic type are closely linked to the systems and methods used for the control of these actuators.

According to known methods, based for instance on open loop control systems, when each valve is opened or closed, the corresponding actuators are supplied with currents and/or voltages of a value such as to ensure that the valve, irrespective of the resistance opposing it, reaches the desired position within a predetermined time interval.

These methods have some drawbacks.

In the first place, the valves are subject to impacts each time that they come into contact with fixed members in the position of maximum opening (lower contact) or in the closed position (upper contact). This is particularly critical, since the valves are subject to an extremely high number of opening and closing cycles and therefore wear very rapidly.

The fact that the electrical power supplied must always be sufficient to overcome the maximum resistance that the valve may encounter, even though the operating conditions are such that the actual resistance opposing the valve is lower, is also a drawback. In this way, the overall efficiency of the drive unit is reduced as a result of the waste of electrical power.

It is also particularly important that a robust control is implemented so as to enable the intake and exhaust valves to be actuated according to desired movement and timing profiles, irrespective of the disturbances that take place and cause the actual operating conditions to deviate from the nominal conditions. The occurrence of a wide range of phenomena may make the actual operating conditions extremely variable.

For instance, engine temperature variations cause expansions and contractions of materials, as a result of which the friction encountered by the valves may change. Moreover, since the force applied to the ferromagnetic members on which the electromagnets act depends in a highly non-linear manner on the distance between these ferromagnetic members and the polar heads, it will be appreciated that the volume variations caused by heat gradients may have an adverse effect on the control. Further disturbances are due to the fact that the resistance encountered by the valves also depends on the pressure in the combustion chamber which varies depending, for instance, on the torque and power requirement of the consumer and on the engine control strategies implemented.

SUMMARY OF THE INVENTION

The object of the present invention is to provide a method for the control of electromagnetic actuators that is free from the above-described drawbacks and, in particular, has a reduced sensitivity to disturbances, making it possible to improve the overall efficiency of the drive unit.

The present invention therefore relates to a method for the control of electromagnetic actuators for the actuation of intake and exhaust valves in internal combustion engines, in which an actuator, connected to a control unit, is coupled to a respective valve and comprises a moving member actuated magnetically, by means of a net force, in order to control the movement of the valve between a closed position and a position of maximum opening and an elastic member adapted to maintain the valve in a rest position, which method comprises the stages of a) detecting an actual position Z and an actual velocity V of the valve;

b) determining a reference position $Z_R$ and a reference velocity $V_R$ of this valve;

c) determining, by a feedback control action, an objective force value of this net force to be exerted on the moving ferromagnetic member as a function of the reference position $Z_R$, the actual position Z, the reference velocity $V_R$ and the actual velocity V in order to minimise differences between the actual position Z and the reference position $Z_R$ and between the actual velocity V and the reference velocity $V_R$, which method is characterised in that it comprises the stages of:

d) estimating disturbing forces acting on the valve, e) calculating an actual force as a function of the objective force value and these disturbing forces, f) implementing this actual force value $F_E$.

BRIEF DESCRIPTION OF THE DRAWINGS

The invention is set out in further detail below with reference to a non-limiting embodiment thereof, given purely by way of non-limiting example, and made with reference to the accompanying drawings, in which.

DETAILED DESCRIPTION OF THE INVENTION

Figure 1:
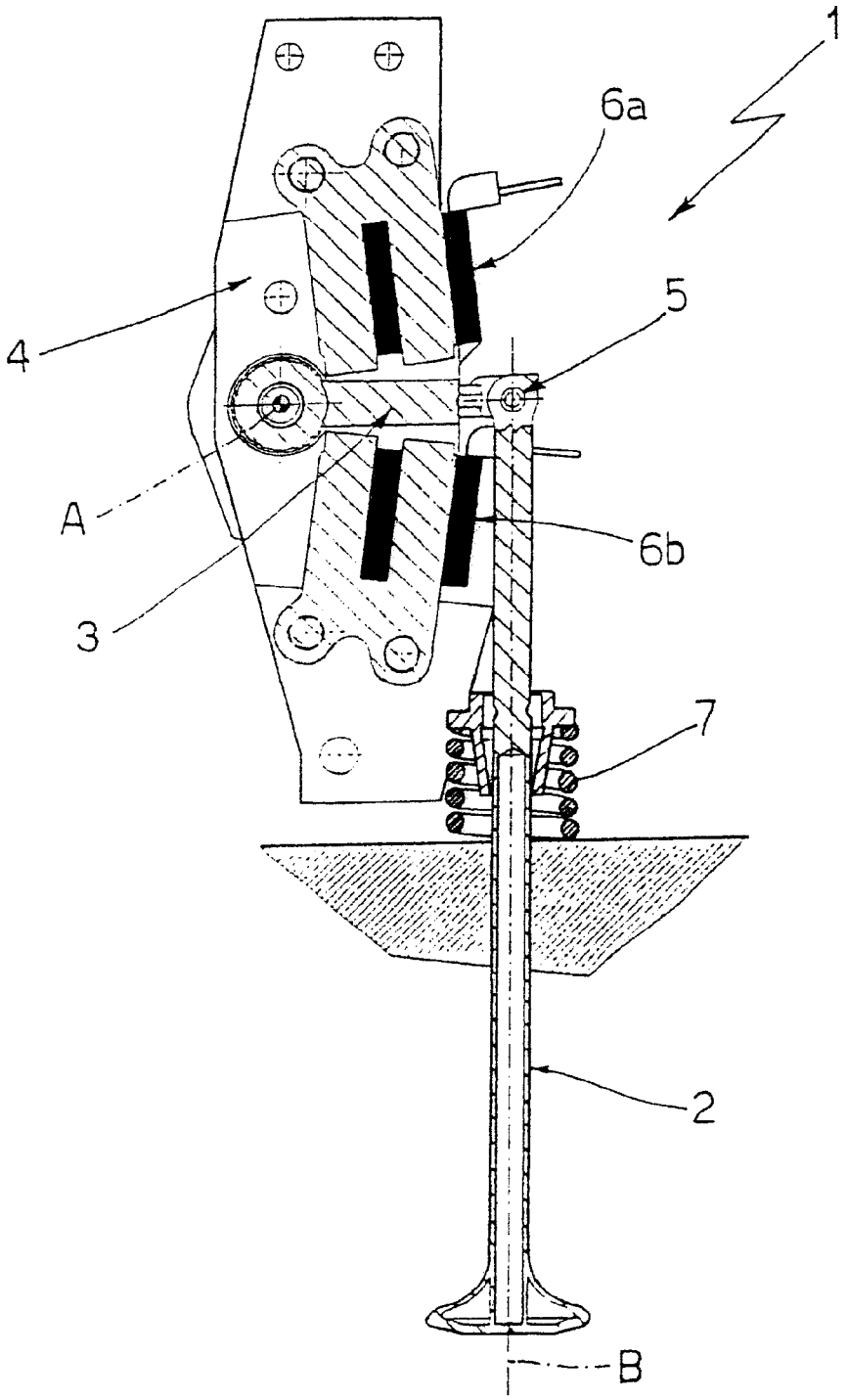
FIG. 1 is a lateral elevation, partly in cross-section, of a first type of intake or exhaust valve and of the corresponding electromagnetic actuator.

In FIG. 1, an electromagnetic actuator 1, controlled by a control system of the present invention, is coupled to an intake or exhaust valve 2 of an internal combustion engine and comprises an oscillating arm 3 of ferromagnetic material, having a first end hinged on a fixed support 4 so as to be able to oscillate about a horizontal axis of rotation A perpendicular to a longitudinal axis B of the valve 2, and a second end connected via a hinge 5 to an upper end of the valve 2, an opening electromagnet 6*a* and a closing electromagnet 6*b* disposed on opposite sides of the body of the oscillating arm 3 so as to be able to act on command, simultaneously or alternatively, by exerting a net force F on the oscillating arm 3 in order to cause it to rotate about the axis of rotation A and an elastic member 7, adapted to maintain the oscillating arm 3 in a rest position in which it is equidistant from the polar heads of the opening and closing electromagnets 6*a* and 6*b*, so as to maintain the valve 2 in an intermediate position between the closed position (upper contact, $Z_{SUP}$) and the position of maximum opening (lower contact, $Z_{INF}$) which the valve 2 assumes when the oscillating arm 3 is disposed in contact with the polar head of the opening electromagnet 6*a* and with the polar head of the closing electromagnet 6*b* respectively.

For simplicity, reference will be made in the following description to a single valve-actuator unit and, moreover, the opening and closing electromagnets 6*a* and 6*b* will be designated as the upper and lower electromagnet respectively. It will obviously be appreciated that the method described is used for the simultaneous control of the movement of all the intake and exhaust valves of a drive unit.

Reference will always be made to the position of the valve 2 in a direction parallel to the longitudinal axis B, with respect to the rest position which is taken as the starting position; the opening stroke should be understood as a movement of the valve 2 from the closed position to the position of maximum opening, while the closing stroke should be understood as a full stroke in the opposite direction.

All the forces that will be discussed below will, moreover, be considered to be positive when they act in such a way as to close the valve 2 and negative when they tend to open it.

Figure 2:
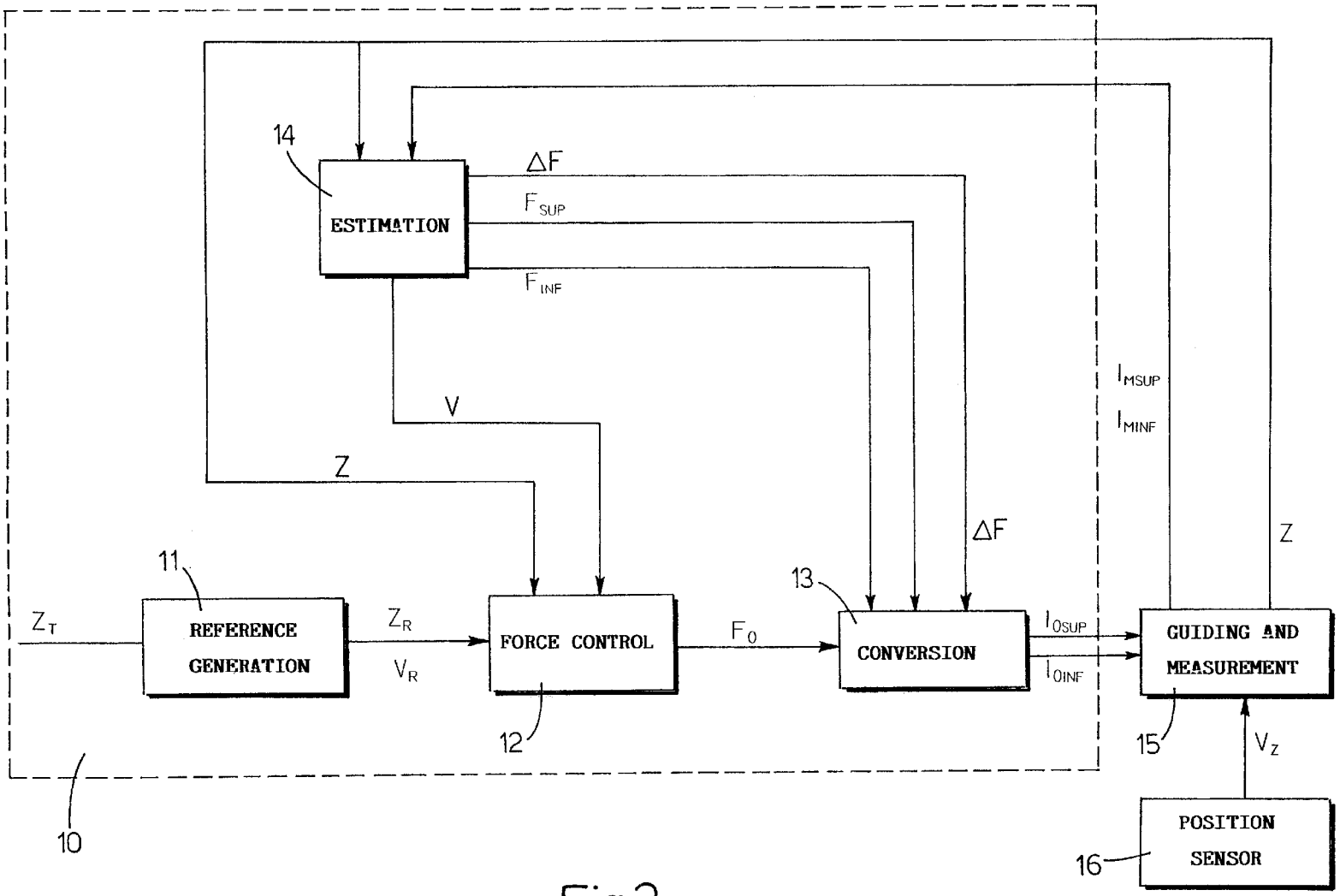
FIG. 2 is a simplified block diagram relating to the control method of the present invention.

As shown in FIG. 2, a control unit 10 comprises a reference generation block 11, a force control block 12, a conversion block 13 and an estimation block 14 and is further interfaced with a guiding and measurement circuit 15.

The reference generation block 11 receives as input an objective position signal $Z_T$, generated in a known manner by the control unit, and a plurality of parameters indicative of the engine operating conditions (for instance the load L and the number of revolutions RPM).

The reference generation block 11 also supplies as output a reference position profile $Z_R$ and a reference velocity profile $V_R$ and supplies them as input to the force control block 12 which also receives a measurement of the actual position Z, supplied by the guiding and measurement circuit 15, and an estimate of the actual velocity V of the valve 2 which is carried out, as described in detail below, by the observation block 14.

The force control block 12 calculates and supplies as output an objective force value $F_o$ indicative of the net force F to be applied to the oscillating arm 3 by means of the electromagnets 6*a* and 6*b* in order to minimise the deviations of the actual position Z and of the actual velocity V from the reference position $Z_R$ and reference velocity $V_R$ profiles respectively.

The objective force value $F_o$ is supplied as input to the conversion block 13 which also receives upper and lower nominal force values $F_{SUP}$ and $F_{INF}$ applied to the oscillating arm 3 by the upper and lower electromagnets 6*a* and 6*b* respectively in nominal conditions, and a estimate of disturbing forces ΔF. The values of the upper and lower nominal forces $F_{SUP}$ and $F_{INF}$ and the estimate of the disturbing forces ΔF are supplied by the observation block 14, as will be described in detail below.

The conversion block 13 supplies as output a pair of upper and lower objective current values $I_{OSUP}$ and $I_{OINF}$ that need to be applied to the upper electromagnet 6*a* and the lower electromagnet 6*b* respectively in order to generate the objective force value $F_o$.

The guiding and measurement circuit 15, of known type, receives as input the objective current values $I_{OSUP}$ and $I_{OINF}$ and causes the corresponding upper and lower electromagnets 6*a* and 6*b* to be supplied with respective actual currents $I_{SUP}$ and $I_{INF}$.

It is connected, moreover, to a position sensor 16 of known type adapted to detect the position of the valve 2 or, in an equivalent way, of the oscillating arm 3. The position sensor 16 supplies a signal $V_Z$ indicative of the actual position Z of the valve 2 to the guiding and measurement circuit 15 which in turn supplies the measurement of the actual position Z and respective measured current values $I_{MSUP}$ and $I_{MINF}$ of the actual currents $I_{SUP}$ and $I_{INF}$ to the control unit 10 and in particular to the observation block 14.

On the basis of the measurements of the actual position Z and the measured current values $I_{MSUP}$ and $I_{MINF}$ and according to methods described in detail below, the estimation block 14 calculates and supplies as output an estimate of the actual velocity V, which is supplied to the force control block 12, an estimate of the disturbing forces ΔF and the values of the nominal forces $F_{SUP}$ and $F_{INF}$ exerted on the oscillating arm 3 by the upper and lower electromagnets 6*a* and 6*b* respectively.

Figure 3:
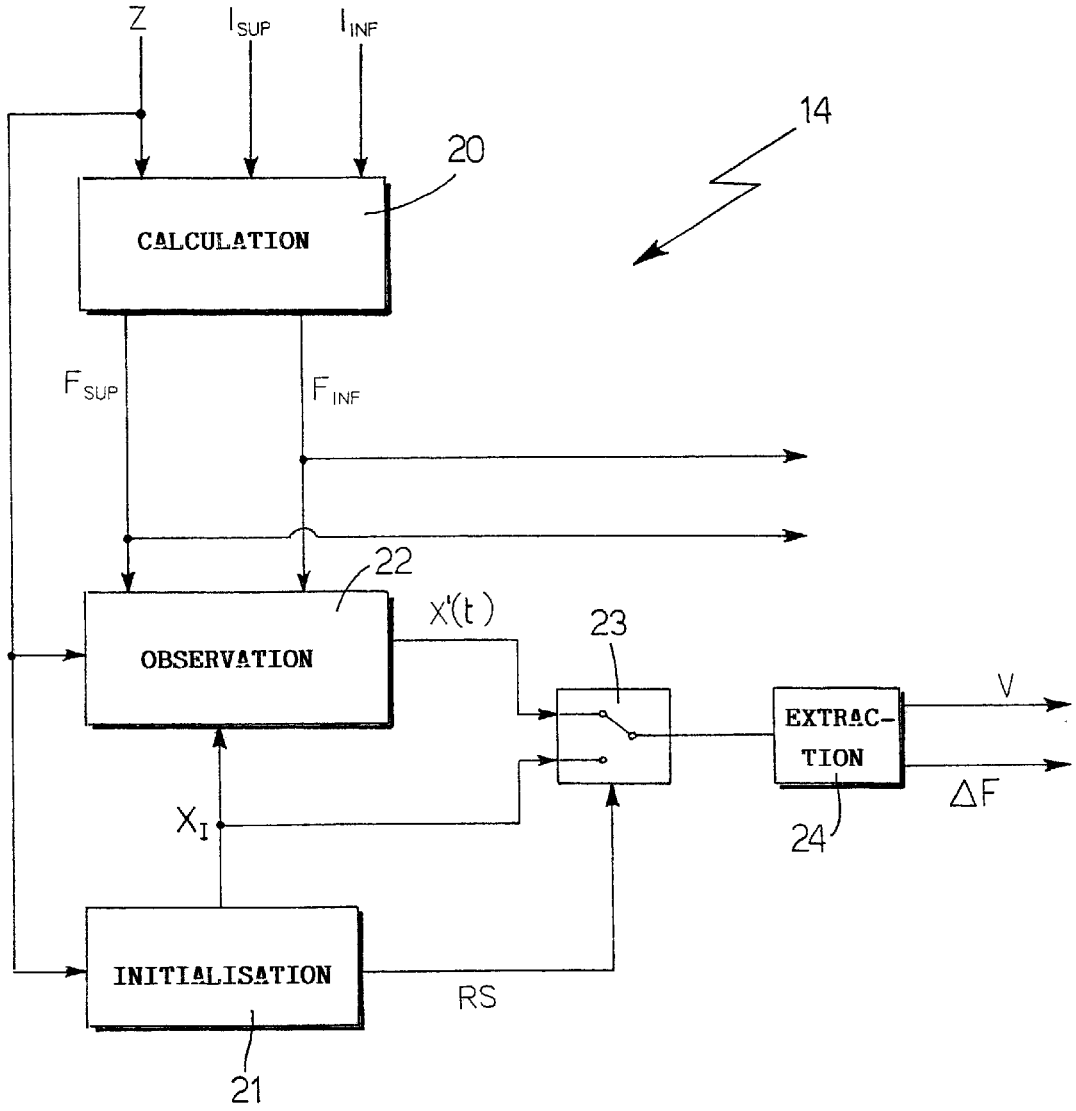
FIG. 3 is a detailed block diagram of a detail of the block diagram of FIG. 2.

In more detail, the estimation block 14 comprises, as shown in FIG. 3, a calculation block 20 which receives as input the measurements of the actual position Z and the measured current values $I_{MSUP}$ and $I_{MINF}$ and supplies as output the values of the nominal forces $F_{SUP}$ and $F_{INF}$ which represent outputs from the estimation block 14.

The measurement of the actual position Z is also supplied as input to an initialization block 21 which supplies as output an initialization signal RS, of logic type, and an initialisation vector $X_1$, whose structure will be explained below.

An observation block 22 receives as input the measurement of the actual position Z, the values of the nominal forces $F_{UPS}$ and $F_{INF}$ and the initialisation vector $X_1$. An estimate of the state vector X'(t), which represents an output from the observation block 22, is calculated on the basis of these inputs.

The estimation block 14 further comprises a selector block 23, controlled by the initialisation block 21 by means of the initialisation signal RS. In particular, the selector block 23 is adapted to connect an input of an extraction block 24 alternatively with the output of the initialisation block 21, when the initialisation signal assumes a first logic value ("TRUE") or with the output of the observation block 22, when the initialisation signal RTS assumes a second logic value ("FALSE").

The extraction block 24 obtains, from the initialisation vector $X_1$ or from the estimate of the state vector X'(t), depending on the value assumed by the initialisation signal RS, estimates of the actual velocity V and of the disturbing forces ΔF and supplies them as outputs of the estimation block 14.

During operation of the engine, the control unit 10, using known strategies, determines the moments of opening and closing of the valve 2. At the same time, it sets the objective position signal $Z_T$ to a value representative of the position that the valve 2 should assume. The objective position signal $Z_T$ is in particular assigned an upper value $Z_{SUP}$ corresponding to the upper contact or a lower value $Z_{INF}$ corresponding to the lower contact, depending on whether the control unit 10 has supplied a command to open or close the valve 2.

On the basis of the values of the objective position signal $Z_T$, the load L and the number of revolutions RPM, the reference generation block 11 determines the reference position profile $Z_R$ and the velocity reference profile $V_R$ which respectively represent the position and the velocity which, as a function of time, it is desired to impose on the valve 2 during its displacement between the positions of maximum opening and closure. These profiles may for instance be calculated from the objective position signal $Z_T$ by means of a two-state non-linear filter, implemented in a known manner by the reference generation block 11, or taken from tables drawn up at the calibration stage.

At the same time, the estimation block 14 supplies the values of the upper and lower nominal forces $F_{SUP}$ and $F_{INF}$, the disturbing forces ΔF and the actual velocity V. The disturbing forces ΔF represent the difference between the objective force value $F_o$ and the net force F actually applied to the oscillating arm 3. This difference is due to the variations which, as discussed above, take place with respect to the nominal operating conditions and which have an impact on the movement of the valve 2.

In detail, the calculation block 20 supplies the values of the upper and lower nominal forces $F_{SUP}$ and $F_{INF}$, as shown in FIG. 3. With reference, for simplicity, solely to the upper electromagnet 6*a*, the value of the upper nominal force $F_{SUP}$ is calculated on the basis of the following equations:

$$F_{SUP}=\alpha(D_{SUP})I_{SUP}^2 \quad I_{SUP}<I_{SAT}(D_{SUP}) \tag{1}$$

$$F_{SUP}=\alpha(D_{SUP})I_{SAT}^2(D_{SUP}) \quad I_{SUP}\geq I_{SAT}(D_{SUP}) \tag{2}$$

In equations (1) and (2), $D_{SUP}$ represents a distance between the polar head of the upper electromagnet 6*a* and the oscillating arm 3, α is a coefficient of proportionality and $I_{SAT}$ is a saturation current. In particular, when an actual current $I_{SUP}$ equal to the saturation current $I_{SAT}$ is supplied to the upper electromagnet 6*a*, the maximum upper nominal force $F_{SUP}$ that the upper electromagnet 6*a* is able to exert on the oscillating arm 3 is reached. For actual current values $I_{SUP}$ higher than the saturation current $I_{SAT}$, the upper nominal force $F_{SUP}$ is kept substantially unchanged. The coefficient of proportionality α and the saturation current $I_{SAT}$ depend in a known manner on the distance $D_{SUP}$ and can be obtained by interpolation from respective tables. The lower nominal force $F_{INF}$ may be obtained in a completely analogous manner from the equations (1) and (2), in which use should be made of the actual current $I_{INF}$ and a distance $D_{INF}$ between the polar head of the lower electromagnet 6*b* and the oscillating arm 3 rather than the actual current $I_{SUP}$ and the distance $D_{SUP}$.

As regards the estimates of the actual velocity V and the disturbing forces ΔF carried out by the observation block 22, the method is based on a discrete-time dynamic system S described by the following matricidal equations:

$$X(t+1)=AX(t)+BU.(t) \tag{3}$$

$$Y(t)=CC(t) \tag{4}$$

in which t is an integer representing a generic moment of current sampling and t+l is a sampling moment following immediately thereafter.

Showing the vectors X(t+1) and X(t) and the matrices A, B and C in detail, equations (3) and (4) are respectively equivalent to the equations:

$$\begin{bmatrix} X_1(t+1) \\ X_2(t+1) \\ X_3(t+1) \\ X_4(t+1) \end{bmatrix} = \begin{bmatrix} 1 & \Delta t & 0 & 0 \\ K\Delta t/M & 1+R\Delta t/M & \Delta t/M & 0 \\ 0 & 0 & 1 & \Delta t \\ 0 & 0 & 0 & 1 \end{bmatrix} \begin{bmatrix} X_1(t) \\ X_2(t) \\ X_3(t) \\ X_4(t) \end{bmatrix} + \begin{bmatrix} 0 \\ \Delta t/M \\ 0 \\ 0 \end{bmatrix} U(t) \tag{5}$$

$$Y(t) = [\,1 \quad 0 \quad 0 \quad 0\,] \begin{bmatrix} X_1(t) \\ X_2(t) \\ X_3(t) \\ X_4(t) \end{bmatrix} \tag{6}$$

In particular, in equations (3) to (6), X(t) and X(t+1) are state vectors of the dynamic system S at the current sampling moment t and at the successive sampling moment t+1; U(t) is an input representative of the total nominal force $F_T$ given by the sum of the upper and lower nominal forces $F_{SUP}$ and $F_{INF}$; Y(t) is an output representing the actual position Z; A is a transition matrix; B is an input matrix and C is an output matrix. Moreover, $X_1$, $X_2$, $X_3$ and $X_4$ are state variables of the dynamic system S corresponding respectively to the actual position Z, the actual velocity V, the disturbing forces ΔF and the variations of the disturbing forces ΔF, K is an elastic constant, R is a viscous constant, M is an equivalent total mass and Δt is a sampling interval.

As will be appreciated by a person skilled in the art, the dynamic system S, as a result of the structure of the transition and output matrices A and C, can be fully observed and it is therefore possible to estimate the state vector X(t+1) from the output Y(t) and from the input U(t) by means of an observer S' described by the following matricidal equations:

$$X'(t+1)=A'X'(t)+B'U'(t) \tag{7}$$

$$Y'(t)=CX'(t) \tag{8}$$

In equations (7) and (8), X'(t) and X'(t+1) are estimates of the state vectors X(t) at the moment t and, respectively, X(t+1) at the successive moment t+1, Y'(t) is an estimate of the output Y(t) and U'(t) is an input vector of the observer S'. In particular, the input vector U't is a column vector having the input U(t) as the first member and the output Y(t) as the second member. Moreover, A' is a transition matrix of the observer S', given by the equation:

$$A'=A+LC \tag{9}$$

in which L is a gain matrix (in this case a column vector with four members) that can be obtained by well-known techniques of pole positioning, in order to ensure that the observer S' converges. The input matrix B' of the observer S' is composed of a first block formed by the matrix of the inputs of the dynamic system S and by a second block formed by the gain matrix L and may be represented by the following equation:

$$B'=[B|L] \tag{10}$$

In operation, the estimate of the state vector X'(t) supplied by the observer S' coincides with the state vector X(t) of the dynamic system S and, consequently, the elements $X'_2(t)$ and $X'_3(t)$ represent estimates of the actual velocity V and of the disturbing forces ΔF at the time t respectively.

Figure 4:
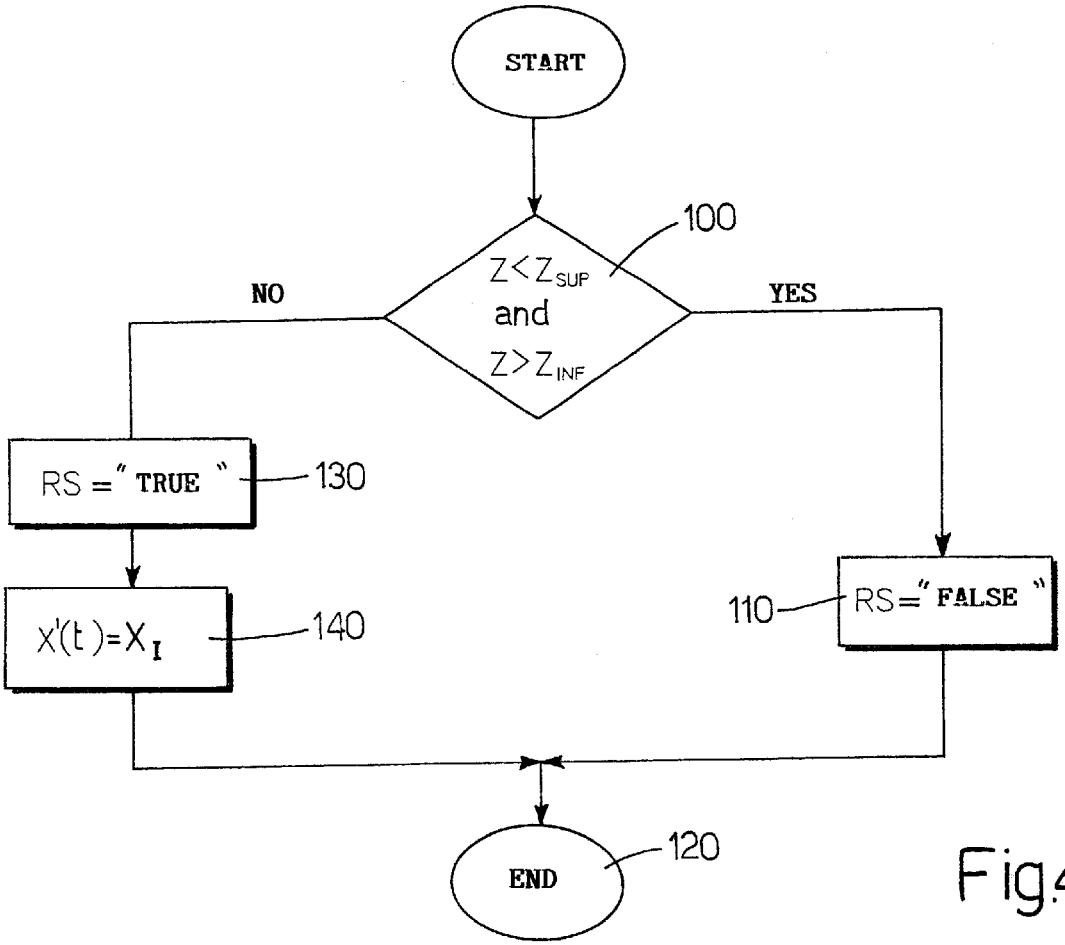
FIG. 4 is a first flow diagram with respect to the present method.

Moreover, as a unilateral constraint is introduced when the valve 2 is at the end of its stroke in the closed position or the position of maximum opening, in these conditions the observer S' is not able to provide correct estimates of the state X(t) of the dynamic system S. In order to maintain the coherence of the state X(t) and avoid convergence transients that would compromise the efficacy of the control, the initialisation block 21 carries out an initialisation procedure that will be described below, with reference to FIG. 4.

In detail, a test is carried out to check whether the valve 2 is in a free section of stroke, assessing whether the actual position Z is strictly between the upper contact $Z_{SUP}$ and the lower contact $Z_{INF}$ (block 100). If this condition is satisfied (output YES from the block 100), the initialisation signal RS is assigned the logic value "FALSE"(block 110) and the procedure is concluded (block 120). If, however, the actual position Z corresponds to the upper contact $Z_{SUP}$ or the lower contact $Z_{INF}$ (output NO from the block 100), the initialisation signal RS is set to the logic value "TRUE" (block 130) and it is imposed that the estimate of the state vector X'(t) of the observer S' is equal to an itialisation vector $X_1$ (block 140) given by the expression:

$$X_1 = \begin{bmatrix} Z \\ 0 \\ 0 \\ 0 \end{bmatrix} \tag{11}$$

The procedure is then terminated (block 120).

The force control block 12 then uses the reference position profile $Z_R$ and velocity reference profile $V_R$, together with the measurement of the actual position Z and the actual velocity V, to determine the objective force value $F_o$ of the net force F that needs to be applied to the oscillating arm 3, according to the following equation:

$$F_o=(N_1Z_R+N_2V_R)-(K_1Z+K_2V) \tag{12}$$

Figure 5:
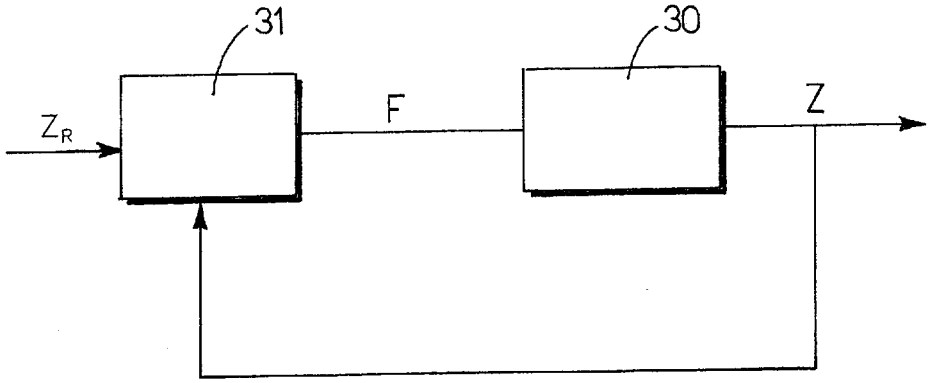
FIG. 5 is a simplified block diagram of a feedback-based dynamic system, implementing the present method.

In (12), $N_1$, $N_2$, $K_1$ and $K_2$ are gains that can be calculated by applying well-known robust control techniques to a reduced dynamic system S", shown by 30 in FIG. 5, that represents the movement of the valve 2 and is described by the matricial equations:

$$\begin{bmatrix} X_1''(t+1) \\ X_2''(t+1) \end{bmatrix} = \begin{bmatrix} 1 & \Delta t \\ K\Delta t/M & 1+R\Delta t/M \end{bmatrix} \begin{bmatrix} X_1''(t) \\ X_2''(t) \end{bmatrix} + \begin{bmatrix} 0 \\ \Delta t/M \end{bmatrix} U''(t) \tag{13}$$

$$Y''(t) = [1 \quad 0] \begin{bmatrix} X_1''(t) \\ X_2''(t) \end{bmatrix} \tag{14}$$

In particular, in the equations (13) and (14), $X_1$" and $X_2$" are state variables of the reduced dynamic system S" calculated at the moment t and at the successive moment t+1 and corresponding to the actual position Z and the actual velocity V respectively; U" (t) is an input representing the net force F and Y"(t) is an output of the reduced dynamic system S" represented by the actual position Z.

The force control block 12 therefore carries out, with respect to the reduced dynamic system S", the function of a feedback controller, shown by 31 in FIG. 5, which uses the net force F as the control variable in order to impose that the controlled variable, i.e. the actual position Z, has a course that is as close as possible to a predetermined course given by the reference position profile $Z_R$.

Figure 6:
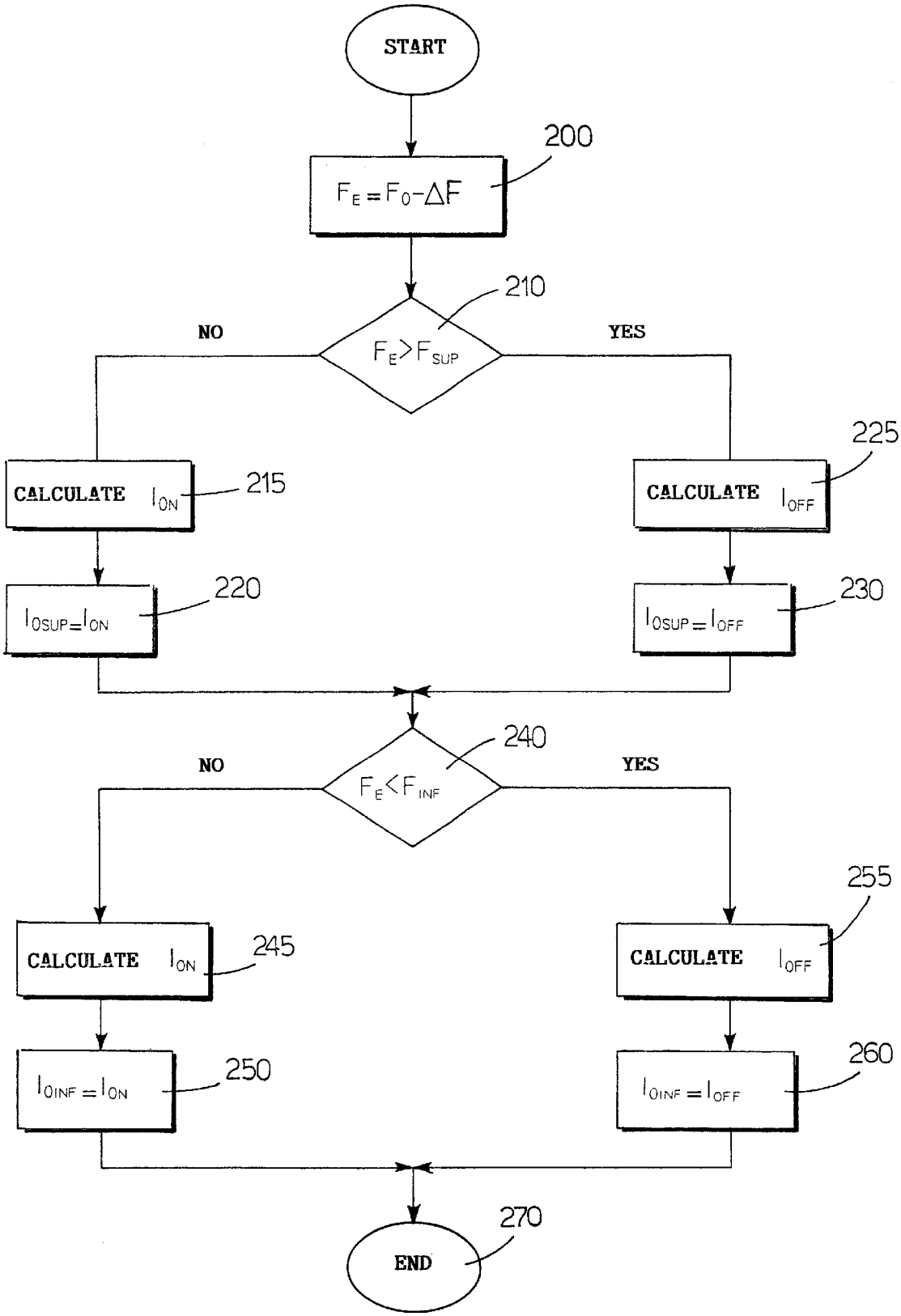
FIG. 6 is a second flow diagram with respect to the present method.

As mentioned above, the objective force value $F_o$ calculated by the force control block 12 and the values of the upper and lower nominal forces $F_{SUP}$ and $F_{INF}$ are used by the conversion block 13 to determine, according to a control procedure known as "switching", that will be explained below with reference to FIG. 6, the objective current values $I_{OSUP}$ and $I_{OINF}$ of the respective currents $I_{SUP}$ and $I_{INF}$ that need to be supplied to the upper and lower electromagnets 6*a* and 6*b*. It will be appreciated that all the forces mentioned in the description are considered to be positive when they act in such a way as to close the valve 2 and negative when they act in such a way as to open it. Consequently, the upper nominal force $F_{SUP}$ is always positive (or possibly zero), the lower nominal force $F_{INF}$ is always negative, and the nominal force F, the objective force $F_o$ and the disturbing forces ΔF may be both positive or negative.

In detail, at the beginning of the procedure for determining the objective current values $I_{OSUP}$ and $I_{OINF}$, an actual force value $F_E$ that it is necessary to supply in order to exert on the oscillating arm 3 a net force F of a value equal to the objective force value $F_o$ is calculated. For this purpose, account also has to be taken of the disturbing forces ΔF, subtracting them from the objective force value $F_o$ (block 200). The implementation of the actual force $F_E$ is then controlled. A test is therefore carried out in which the actual force $F_E$ and the upper nominal force $F_{SUP}$ are compared (block 210). If the actual force $F_E$ is greater than the upper nominal force $F_{SUP}$ (output YES from the block 210), an actuation current value $I_{ON}$ is calculated (block 215) and the upper objective current value $I_{OSUP}$ is set to this actuation value $I_{ON}$ (block 220). If not (output NO from the block 210), an exclusion current value $I_{OFF}$ is calculated (block 225) and the upper objective current value $I_{OSUP}$ is set to this exclusion value $I_{OFF}$ (block 230). The actuation value $I_{ON}$ and the exclusion value $I_{OFF}$ are calculated as a function of the distance between the polar heads of the electromagnets 6*a* and 6*b* and the oscillating arm 3 as explained below.

A test is then carried out to check whether the actual force $F_E$ is lower than the lower nominal force $F_{INF}$ (block 240). If so (output YES from the block 240), an actuation current value $I_{ON}$ is calculated (block 245) and the lower objective current value $I_{OINF}$ is set to this actuation value $I_{ON}$ (block 250). Otherwise (output NO from the block 240), an exclusion current value $I_{OFF}$ is calculated (block 255) and the lower objective current value $I_{OFF}$ is set to this exclusion value $I_{OFF}$ (block 260).

The procedure is then terminated (block 270).

The dependence of the actuation and exclusion current values $I_{ON}$ and $I_{OFF}$ on the distance between the polar heads of the electromagnets 6*a* and 6*b* and the oscillating arm 3 will now be discussed again with reference solely to the upper electromagnet 6*a*, without entering into superfluous detail.

Figure 7:
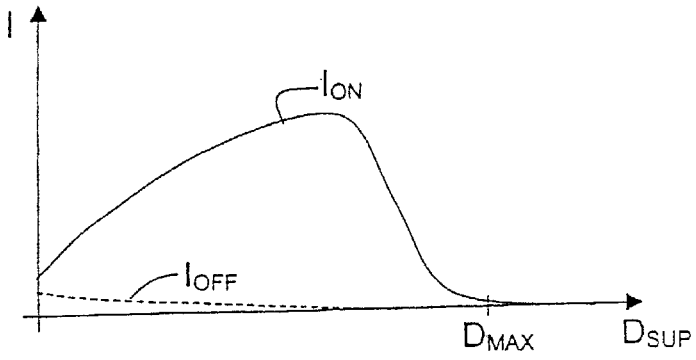
FIG. 7 is a graph relating to current values calculated in accordance with the present method.

In the graph of FIG. 7, the distance $D_{SUP}$ is shown on the abscissa and the curve of the actuation current values $I_{ON}$ is shown by a continuous line, while the exclusion current values $I_{OFF}$ are shown in dashed lines. For low values of the distance $D_{SUP}$, the actuation current $I_{ON}$ is close to the saturation current $I_{SAT}$; as the distance $D_{SUP}$ increases the actuation current $I_{ON}$ firstly moves away from the saturation current $I_{SAT}$, then decreases until it becomes substantially zero beyond a distance $D_{MAX}$. The exclusion current $I_{OFF}$, however, is maximum when the distance $D_{SUP}$ is zero and gradually decreases until it is cancelled out, without ever exceeding the actuation current $I_{ON}$.

The actuation and exclusion current values $I_{ON}$ and $I_{OFF}$ my be taken from tables. In particular, in order to optimize these values, it is possible to use separate tables for each of the upper and lower electromagnets 6*a* and 6*b* and, moreover, for the opening and closing strokes, depending on whether the action of these electromagnets is to promote or oppose the movement of the valve 2.

It should be stressed that both the upper and lower electromagnets 6*a* and 6*b* can be supplied during a same closing or opening stroke of the valve 2, to enable the net force F exerted on the oscillating arm 3 to have a value equal to the objective force value $F_o$. For instance, if during a closing stroke, in which the valve 2 moves between the position of maximum opening and the closed position, the actual velocity V of the valve 2 exceeds the reference velocity $V_R$, the force control block 12 can generate an objective force value $F_o$ such as to exert a braking action on this valve 2. This braking action is thus obtained by de-activating the upper electromagnet 6*a* and supplying the lower electromagnet 6*b* while the valve 2 is still moving towards the upper contact $Z_{SUP}$. Vice versa, during an opening stroke, in which the valve 2 is moving between the closed position and the position of maximum opening, the upper electromagnet 6*a* is used to brake the valve 2, while the lower electromagnet 6*b* makes it possible to accelerate the valve 2.

The stages of supply and de-activation of the electromagnets 6*a* and 6*b* in order to accelerate or brake the valve 2 as described above are repeated in sequence several times during each opening and closing stroke, preferably with a frequency of some 20 kHz, so as to minimise the deviations of the actual position Z and the actual velocity V of the valve 2 from the reference position profile $Z_R$ and the reference velocity profile $V_R$ respectively.

The method described above has the following advantages.

In the first place, the use of the estimate of force disturbances ΔF makes it possible to impose a robust control and to reduce its sensitivity to unforeseeable variations of the operating conditions, such as those already described and brought about by heat gradients, to different pressure conditions of the gases within the combustion chamber, or caused by wear. In particular, the estimate of the disturbing forces ΔF makes it possible simply to take account of the overall effect of all the disturbances acting on the valve 2. Consequently, it is possible to cause the valves accurately to follow desired position and velocity courses, and to moderate velocity at the end-of-stroke sections, so that the contact between the valves and the fixed members takes place gently. This makes it possible to obtain a so-called "soft touch", avoiding impacts that would substantially reduce the life of the valves and would make the use of electromagnetic actuation systems problematic for mass-produced vehicles.

Moreover, the estimate of the actual velocity V, which is a key parameter for the efficacy of the control, is carried out by means of the observer S'. In this way, this estimate is extremely accurate and has a very low sensitivity to disturbances.

The use of a "switching" control procedure advantageously makes it possible to determine the objective currents $I_{OSUP}$ and $I_{OINF}$ efficiently with a low computational input.

Further advantages are due to the calculation of the actuation and exclusion current values $I_{ON}$ and $I_{OFF}$ according to the curves described. In this way, the electromagnet that is actuated receives high current values if the oscillating arm 3 is close to its polar head and consequently there is a high speed of response. Moreover, in the above conditions exclusion current values $I_{OFF}$ that are not zero are supplied. This avoids an initial absorption due to parasitic currents and the response time is further improved. If, however, the distance between the polar head of the electromagnet and the oscillating arm 3 is high, it would be necessary to supply extremely high currents even to exert forces of a moderate value having almost no impact. Low or zero actuation current values $I_{ON}$ are therefore supplied and the corresponding electromagnet is excluded, advantageously obtaining a substantial saving.

It will therefore be appreciated that the proposed method advantageously makes it possible to reduce current consumption and substantially to improve the overall performance of the drive unit. As a result of the lower current absorption, moreover, there is less risk of damage to the windings of the electromagnets as a result of overheating.

Figure 8:
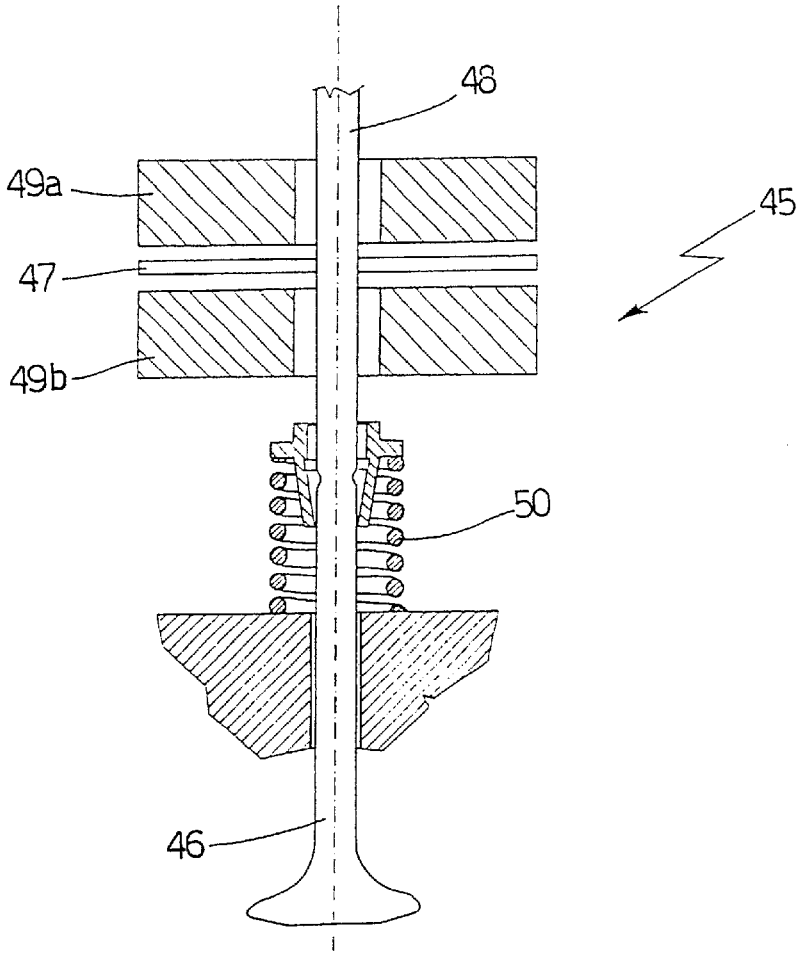
FIG. 8 is a lateral elevation, partly in cross-section, of a second type of intake or exhaust valve and of the corresponding electromagnetic actuator.

The proposed method may, moreover, also be used for the control of valve actuator units other than those described with reference to FIG. 1. For instance, as shown in FIG. 8, an actuator 45 cooperates with an intake or exhaust valve 46 and comprises an anchor of ferromagnetic material 47 joined rigidly to a stem 48 of the valve 46 and disposed perpendicular to its longitudinal axis C, a pair of electromagnets 49*a* and 49*b* at least partially bounding the stem 48 of the valve 46 and disposed on opposite sides with respect to the anchor 47, so as to be able to act, on command, alternatively or simultaneously, by exerting a net force F on the anchor 47 in order to cause it to move in translation parallel to the longitudinal axis C and an elastic member 50 adapted to maintain the anchor 47 in a rest position in which it is equidistant from the polar heads of the two electromagnets 49*a* and 49*b* so as to maintain the valve 46 in an intermediate position between the closed position (upper contact) and the position of maximum opening (lower contact) that the valve 46 assumes when the anchor 47 is disposed in contact with the polar head of the upper electromagnet 49*a* and respectively with the polar head of the lower electromagnet 49*b*.

It will be appreciated that modifications and variations may be made to the above description without departing from the scope of the present invention.

What is claimed is:

1. A method for the control of electromagnetic actuators for the actuation of intake and exhaust valves in internal combustion engines, in which an actuator (1, 45), connected to a control unit (10), is coupled to a respective valve (2, 46) and comprises a moving member (3, 47) actuated magnetically, by means of a net force (F), in order to control the movement of the valve (2, 46) between a closed position ($Z_{SUP}$) and a position of maximum opening ($Z_{INF}$) and an elastic member (7, 50) adapted to maintain the valve (2, 46) in a rest position, which method comprises the stages of:

a) detecting an actual position (Z) and an actual velocity (V) of the valve (2, 46);

b) determining a reference position ($Z_R$) and a reference velocity ($V_R$) of this valve (2, 46);

c) determining, by a feedback control action, an objective force value ($F_o$) of this net force (F) to be exerted on the moving ferromagnetic member (3, 47) as a function of the reference position ($Z_R$), the actual position (Z), the reference velocity ($V_R$) and the actual velocity (V) in order to minimise differences between the actual position (Z) and the reference position ($Z_R$) and between the actual velocity (V) and the reference velocity ($V_R$), which method is characterised in that it comprises the stages of:

d) estimating disturbing forces ($\Delta F$) acting on the valve (2, 46), e) calculating an actual force ($F_E$) as a function of the objective force value ($F_o$) and these disturbing forces ($\Delta F$), f) implementing this actual force value ($F_E$).

2. A method as claimed in claim 1, characterised in that the stage d) of estimating the disturbing forces comprises the stage of:

d1) providing an estimate (X') of a state (X) of a dynamic system (S) by means of an observer (S'), a first state variable ($X_3$) of this dynamic system (S) being formed by these disturbing forces ($\Delta F$).

3. A method as claimed in claim 2, characterised in that the stage d1) of providing this estimate (X') comprises the stage of:

d11) calculating an estimate (X'(t+1)) at a successive sampling moment ((t+1)) as a function of an estimate (X'(t)) at a current sampling moment ((t)).

4. A method as claimed in claim 3, characterised in that the stage d11) of calculating this estimate (X'(t+1)) at this successive sampling moment ((t+1)) comprises the stage of:

d111) calculating this estimate (X'(t+1)) at a successive sampling moment ((t+1)) according to the matricial equation:

$$X'(t+1)=A'X'(t)+B'U'(t)$$

A' being a first transition matrix, B' being a first input matrix and U'(t) being an input vector of the observer (S').

5. A method as claimed in claim 4, characterised in that the stage d111) of calculating the estimate (X'(t+1)) according to the matricidal equation comprises the stage of:

d1111) calculating this first transition matrix A' according to the matricial equation:

$$A'=A+LC$$

A being a second transition matrix, C being an output matrix of the dynamic system (S) and L being a gain matrix of the observer (S').

6. A method as claimed in claim 1, characterised in that the stage e) of calculating an actual force ($F_E$) comprises the stage of:

e1) subtracting the disturbing forces ($\Delta F$) from the objective force value ($F_o$).

7. A method as claimed in claim 1, in which the actuator (1, 45) further comprises at least a first and second electromagnet (6*a*, 6*b*, 49*a*, 49*b*) disposed on opposite sides with respect to the moving member (3, 47) and in which the valve (2, 46) travels an opening stroke when moving from the closed position ($Z_{SUP}$) to the position of maximum opening ($Z_{INF}$) and a closing stroke when moving from the position of maximum opening ($Z_{INF}$) to the closed position ($Z_{SUP}$), which method is characterised in that the stage f) of implementing the actual force value ($F_E$) comprises the stage of:

f1) supplying both the first and the second electromagnets (6*a*, 6*b*, 49*a*, 49*b*) at least once during each opening and closing stroke of the valve (2, 46).

8. A method as claimed in claim 7, characterised in that the stage f1) of supplying both the first and the second electromagnets (6*a*, 6*b*, 49*a*, 49*b*) at least once follows the stage of:

f2) calculating, as a function of the actual position (Z) and of respective measured current values ($I_{MSUP}$, $I_{MINF}$), a first and a second nominal force value ($F_{SUP}$, $F_{INF}$) exerted by the first and second electromagnet (6*a*, 6*b*, 49*a*, 49*b*) respectively on the moving member (3, 47).

9. A method as claimed in claim 7, characterised in that the stage f1) of supplying both the first and the second electromagnets (6*a*, 6*b*, 49*a*, 49*b*) at least once comprises the stage of:

f11) calculating at least a first and a second objective current value ($I_{OSUP}$, $I_{OINF}$) as a function of the objective force value ($F_o$) and f12) supplying the first and the second electromagnets (6*a*, 6*b*, 49*a*, 49*b*) with a first and a second current ($I_{SUP}$, $I_{INF}$) having values equal to the first and the second objective current values ($I_{OSUP}$, $I_{OINF}$) respectively.

10. A method as claimed in claim 9, characterised in that the stage f11) of calculating at least a first and a second objective current value ($I_{OSUP}$, $I_{OINF}$) comprises the stage of:

f111) calculating for each of the first and the second electromagnets (6*a*, 6*b*, 49*a*, 49*b*) at least one actuation current value ($I_{ON}$) and at least one exclusion current value ($I_{OFF}$) (215, 225, 245, 255) as a function of respective distances ($D_{SUP}$, $D_{INF}$) of the moving member (3, 47) from the first electromagnet (6*a*, 49*a*) and from the second electromagnet (6*b*, 49*b*).

11. A method as claimed in claim 9, characterised in that the stage f11) of calculating at least a first and a second objective current value ($I_{OSUP}$, $I_{OINF}$) further comprises the stages of:

f112) setting this first objective current value ($I_{OSUP}$) to this actuation value ($I_{ON}$) if the actual force ($F_E$) is greater than the first nominal force ($F_{SUP}$), f113) setting this first objective current value ($I_{OSUP}$) to this exclusion value ($I_{OFF}$) if the actual force ($F_E$) is smaller than the first nominal force ($F_{SUP}$), f114) setting this second objective current value ($I_{OINF}$) to this actuation value ($I_{ON}$) if the actual force ($F_E$) is smaller than the second nominal force ($F_{INF}$), f115) setting this second objective current value ($I_{OINF}$) to this exclusion value ($I_{OFF}$) if the actual force ($F_E$) is greater than the second nominal force ($F_{INF}$).

12. A method as claimed in claim 1, characterised in that the stage a) of detecting the actual position (Z) and the actual velocity (V) comprises the stage of:

a1) estimating the actual velocity (V).

13. A method as claimed in claim 12, in which a second state variable ($X_2$) of the dynamic system (S) is formed by the actual velocity (V), characterised in that the stage a1) of estimating the actual velocity (V) comprises the stages of:

d1) providing an estimate (X') of a state (X) of a dynamic system (S), d11) calculating an estimate ((X'(t+1)) at a successive sampling moment ((t+1)), d111) calculating this estimate (X'(t+1)) at this successive sampling moment ((t+1)) according to the matricidal equation:

$$X'(t+1)=A'X'(t)+B'U'(t),$$

d1111) calculating the first transition matrix A' according to the matricidal equation:

$$A'=A+LC.$$

* * * * *